US009419399B2

(12) United States Patent
Viviroli

(10) Patent No.: US 9,419,399 B2
(45) Date of Patent: Aug. 16, 2016

(54) CRIMPING STATION

(71) Applicant: Komax Holding AG, Dierikon (CH)

(72) Inventor: Stefan Viviroli, Horw (CH)

(73) Assignee: Komax Holding AG, Dierikon (CH)

( * ) Notice: Subject to any disclaimer, the term of this patent is extended or adjusted under 35 U.S.C. 154(b) by 382 days.

(21) Appl. No.: 14/173,959

(22) Filed: Feb. 6, 2014

(65) Prior Publication Data

US 2014/0245601 A1 Sep. 4, 2014

(30) Foreign Application Priority Data

Mar. 4, 2013 (EP) ..... 13157650

(51) Int. Cl.
*H01R 43/048* (2006.01)
*H01R 43/052* (2006.01)

(52) U.S. Cl.
CPC ..... *H01R 43/048* (2013.01); *H01R 43/052* (2013.01); *Y10T 29/53235* (2015.01)

(58) Field of Classification Search
CPC ..... H01R 43/048; H01R 43/052; Y10T 29/53236
See application file for complete search history.

(56) References Cited

U.S. PATENT DOCUMENTS 4,031,613 A * 6/1977 Brown ..... H01R 43/048 29/753
4,040,180 A * 8/1977 Brown ..... H01R 43/04 29/753
5,611,141 A 3/1997 Takada et al.
5,745,982 A * 5/1998 Klinedinst ..... H01R 43/048 29/753
5,907,901 A * 6/1999 Hogan, Jr. ..... H01R 43/048 29/33 M
6,067,828 A * 5/2000 Bucher ..... B30B 15/146 29/751
6,438,823 B2 * 8/2002 Yamakawa ..... H01R 43/058 29/33 M
6,658,725 B1 * 12/2003 Liu ..... H01R 43/058 29/33 M
7,152,310 B2 * 12/2006 Conte ..... H01R 43/048 29/33 M
8,519,267 B2 * 8/2013 Peters ..... H01R 4/62 174/122 C
2014/0150260 A1 * 6/2014 Fischer ..... H01R 43/055 29/862

FOREIGN PATENT DOCUMENTS

EP 1351349 A1 10/2003
WO 2011/004272 A1 1/2011

* cited by examiner

*Primary Examiner* — Carl Arbes
(74) *Attorney, Agent, or Firm* — Fraser Clemens Martin & Miller LLC; William J. Clemens

(57) ABSTRACT

A crimping station with a crimping press for producing a crimp connection, the crimping press including a drivable press part movable in vertical direction, with which a cable end of a cable can be connected with a crimp contact, a gripper for supplying the cable end to the crimping press, and a positioning unit for vertically positioning the cable end at the crimping press. During the process of moving the press part the gripper is moved by the positioning unit between a starting position and an end position. The positioning unit is connected via a variable gearbox with the press part whereby during the moving of the press part, the positioning unit is moved in relation to the press part at a speed reduced by a reduction ratio of the gearbox, and the reduction ratio can be adjusted by an adjusting device.

10 Claims, 5 Drawing Sheets

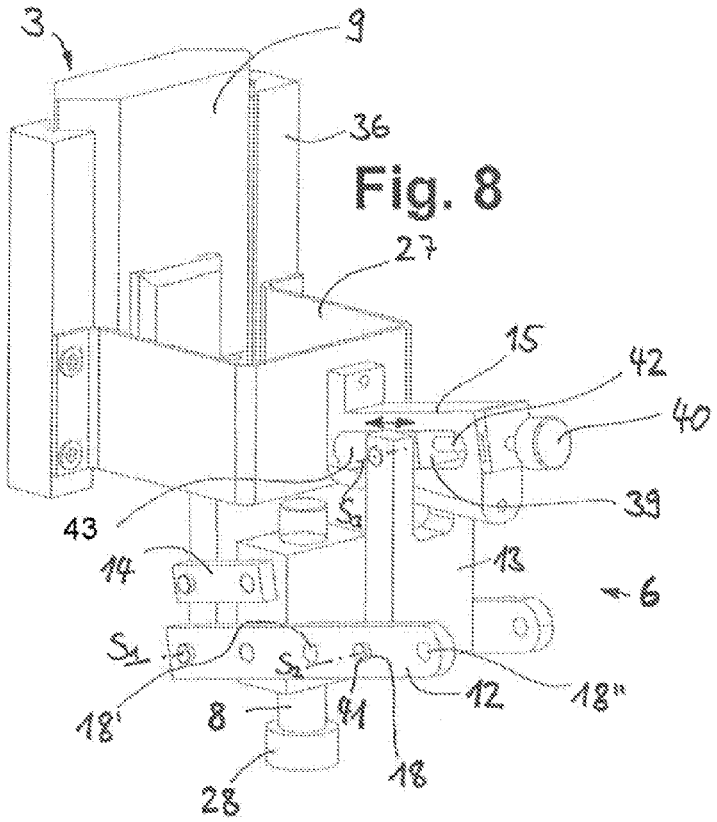
Fig. 8
Fig. 9
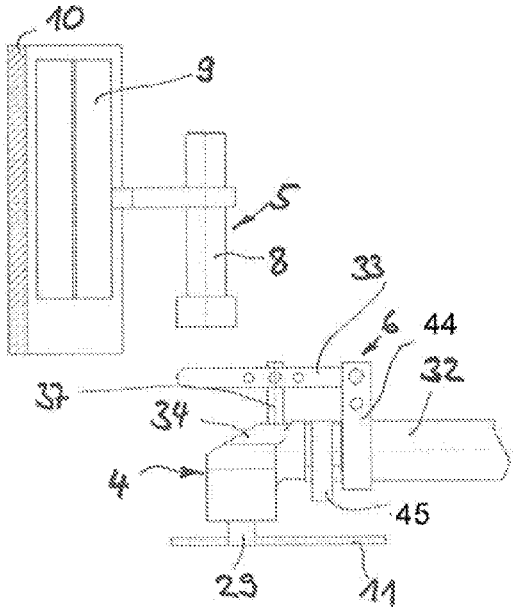
Fig. 10
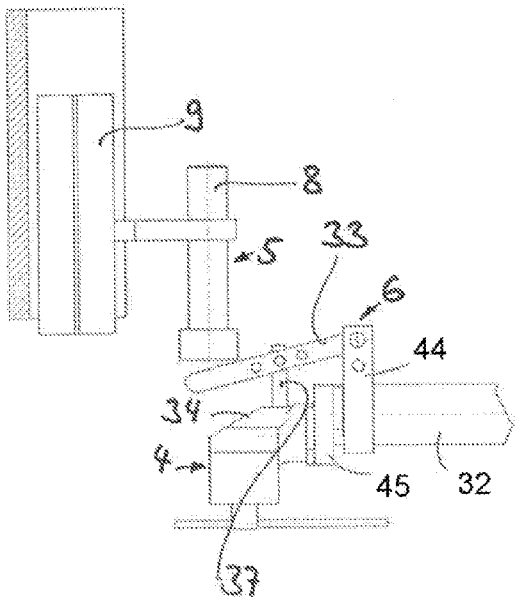

CRIMPING STATION

FIELD

The invention relates to a crimping station for producing a crimp connection wherein a cable end of a cable is connected with a crimp contact.

BACKGROUND

Methods for manufacturing crimped connections are known and have been in use for a long time. EP 1 351 349 A1 discloses a crimping station, which comprises a crimping press with a press part that can be moved in a vertical direction (so-called "crimping ram"), by means of which a cable tail of a cable can be connected with a crimp contact. The crimping station further includes a gripper, which supplies the cable to the crimping press by swiveling about a vertical swivel axis. During the crimping process, the supplied cable end is lowered by means of a positioning unit together with the crimping press. In an uppermost position of the movable press part (starting position), the positioning unit or a stop surface of a ram of the positioning unit facing the cable gripper is spaced from the cable gripper, ensuring that the cable remains stationary at the beginning of the crimping process. This crimping station has a special actuator, by means of which it is possible to easily adjust the spacing to different crimps, cable diameters or crimping tool configurations. In practice, it has been shown that a precise vertical positioning of the cable end in the crimping press during the crimping process greatly affects the crimp quality. Since the ram of the positioning unit is rigidly connected to the crimping press, problems can occur, especially with fast crimping processes. For example, abrupt impinging of the positioning unit on the cable gripper can lead to undesirable vibrations in the cable and to large mechanical stresses on the elements involved.

WO 2011/004272 A1 relates to a crimping station with which the lowering movement of a positioning unit can be controlled. The positioning unit consists of a tubular lowering element and a movably mounted ram therein. The cable gripper is first moved vertically to an intermediate position by means of the lowering member moving vertically down. This first lowering movement is predetermined by a control cam with a beveled edge mounted on the slide of the crimping press. The further lowering movement from the intermediate position to the end position is then carried out through the internal ram overtaking the lowering member, which ram is rigidly attached to the movable press part. This results in an undesirable excess pressure applied to the cable end at the end of the crimping process. Another disadvantage of this arrangement is that the field of application for the respective crimping station is limited and not flexible. For example, when changing to different cables, crimp connections or crimping tools, expensive re-fitting processes are necessary, in which the component with the control cam have to be removed and replaced with another component.

SUMMARY

Therefore, the present invention has an object of avoiding the disadvantages of the currently known crimp stations and in particular providing a crimping station of the aforementioned type, which is characterized by high flexibility with respect to varying cables, crimp connections or different crimping tools. Furthermore, the crimping station should be easy to handle and operate. In addition, the crimping station should allow for a gentle treatment of the cable during the crimping process, resulting in high quality crimp connections.

These and other problems are solved with the crimping station comprising a crimping press for producing the crimp connection, a gripper for feeding the cable end to the crimping press, and a positioning unit for vertically positioning the cable end in the crimping press. The crimping press has a press part, which can be actuated, for example by means of an electric motor, and which can be moved in vertical direction, preferably against a stationary anvil, to which a cable end of a cable can be connected with a crimp contact. The press part can comprise a vertically directed slide disposed to be movable on which by means of a tool holder a crimping tool with a crimping punch has been arranged. In generally known manner, the crimping punch can be designed in two parts for manufacturing the insulation and the wire crimp. By means of the positioning unit which, for example, includes a vertically extending ram, the gripper can be moved between an initial position and an end position when the press part is moved during the crimping process. For example, the positioning unit can cause the desired movement of the gripper by hitting or otherwise impinging the gripper. A number of benefits result from the fact that the positioning unit is thus connected to the press part via a variable gearbox, that during the process of moving the press part the positioning unit can be moved toward the press part at a speed reduced by a reduction ratio, and that the reduction ratio can be adjusted by means of an adjusting device. By means of the adjusting device, it is possible to adjust in a simple manner the reduction ratio to changing operational parameters, such as different cable thicknesses of the cables to be processed. The possibility of adjusting the gearbox reduces the switching time and lowers operating costs.

Instead of connecting the gearbox of the positioning unit on or with the press part, it is also possible that the gripper forms an active connection with the positioning unit via a variable gearbox. At the same time, the gearbox can be associated with the gripper and connected with the gripper via the gearbox. In this case, the positioning unit could even be solidly or rigidly connected with the press part.

The gearbox can be configured as a continuously variable transmission. The gearbox can comprise coupling agents for mechanically coupling and uncoupling components of the gearbox in order to create the predefined position. Alternatively, it is particularly preferred when the gearbox comprises also predefined positions for setting different reduction ratios. In particular, the last-mentioned gearbox can be manufactured in a simple and cost-effective manner and is characterized by a robust construction.

It can be advantageous when the gearbox of the positioning is connected with the press part via a lever mechanism, wherein said gearbox comprises means for changing the lever geometry, and thus for adjusting the reduction ratio.

The gripper can comprise a gripper arm and a gripper head which is preferably flexibly mounted in vertical direction at the end of the gripper arm. The gearbox of the gripper head can be connected with the gripper arm via a lever mechanism in the form of a variable gearbox. At the same time, the gripper head can comprise a stop surface which impinges the positioning unit during the lowering process, whereby the cable can be placed in a simple manner in the desired position during the crimping process. In the event that the gearbox is associated with the gripper, and gripper and gearbox are connected, the stop surface would be associated with the gearbox.

The gearbox can have a lever which is supporting the positioning unit and a swing arm which is flexibly connected with the lever. At the same time, one side of the lever can be flexibly connected with the movable press part. On one side the swing arm can be flexibly connected with a stationary component of the crimping press. A lever mechanism with lever and swing arm can be produced in a simple and cost-effective manner. Such a mechanical solution is characterized by a robust construction, while at the same time it is easy to handle and in a few simple steps it is possible to vary the reduction ratio.

It is especially beneficial when optionally the swing arm can be flexibly connected with the lever at least at two positions for setting different reduction ratios. It is especially preferred that the lever comprises at least two drill holes for providing at least one position for flexibly connecting the swing arm with the lever. For example, such drill holes are able to accept pins, rod ends, or other means for establishing a pivot joint or swivel axis.

Alternative or additional possibilities of adjustment arise when at least two bearings are provided on the crimping press, for example in the form of drill holes, to which the swing arm can be optionally connected in flexible manner.

To form a parallelogram, the positioning unit can be connected with the press part via a short lever arm that extends in parallel fashion to the lever. In this way, it can be ensured that the positioning device is moving in a vertical direction. This can also be achieved when the positioning unit is mounted on or in the lever via a linear guide.

For certain applications, it can be advantageous when the stationary component is an extension piece that can be releasable attached to the crimping press, in particular by means of mounting bolts. If required, the extension piece can be easily replaced without much effort, for example, during extensive changes to other operating parameters, such as different cable thicknesses or crimp connections.

The invention could also be directed to a method for operating the crimping station described above. The method is particularly characterized in that, for example, during the process of changing to different cables that have, for example, a considerably larger or smaller cable diameter, the reduction ratio is adjusted to the new operating parameters through an adjustment of the gearbox.

DESCRIPTION OF THE DRAWINGS

Further details and advantages of the invention will become apparent from the following description of embodiments and from the drawings. It is shown:

FIG. 8 is a perspective view of a crimping press and a positioning unit with a modified gearbox for the crimping station according to a further embodiment.

FIG. 9 is a side elevation view of a positioning unit and a gripper equipped with a lever mechanism, in a starting position.

FIG. 10 shows the arrangement of FIG. 9 in an end position.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
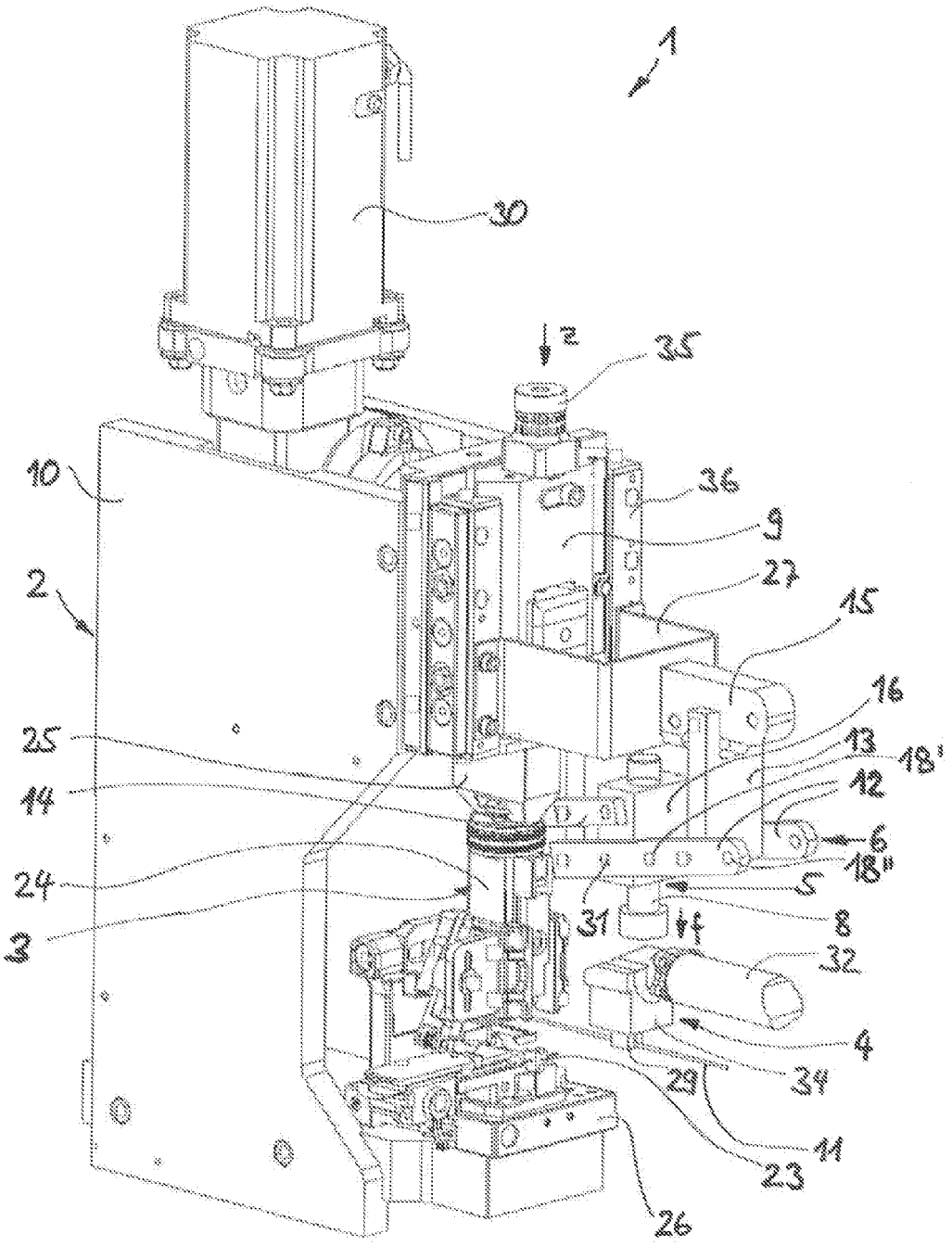
FIG. 1 is a perspective view of an invention-based crimping station.

FIG. 1 shows a crimping station 1 for the production of crimped connections. The crimping station 1 comprises a crimping press 2, which has a press part 3 that can be actuated by means of an electric motor 30 and moved in the vertical direction z. By means of said press part 3 a cable end of a cable 11 can be connected with a crimp contact. The press part 3 essentially consists of a slide 9 led between two guides 36, with a tool holder 25 arranged at the underside of the slide 9. The tool holder 25 carries a crimping tool 24, at which a crimping punch has been arranged for crimping the crimp contact with the cable end. The crimping punch interacts in a known manner with an anvil 23, which forms the counterpart to the crimping punch. The anvil 23 has been arranged on a machine table 26 of the crimping press 2, and could be replaced if necessary. In a pivotal movement about a vertical swivel axis and/or in the transverse direction of the crimping press 2, the cable 11 is supplied to the crimping press 2 with a gripper 4 of the crimping press 2 until the cable end is located between the crimping punch and the anvil 23 (see subsequent FIG. 2). With an adjusting screw 35 the desired crimp height, i.e. the measure between anvil and crimping punch, can be adjusted in the lowest position (end position) of the crimping tool 24.

The gripper 4 comprises a gripper head 34 with gripper jaws 29 that can be moved against one another for detecting the cable 11. For example, the gripper jaws or gripper fingers may be pneumatically activated. The gripper head 34 is mounted in such a way that it can be moved in vertical direction in relation to the horizontal gripper arm 32. Consequently, during a crimping process only the gripper head is moved in the direction f while the gripper arm 34 is at a standstill. Of course, it is also possible to use different gripper configurations. For example, one solution could involve a gripper head that is connected in at least relatively rigid manner with a gripper arm, wherein the gripper arm is lowered together with the gripper head.

During the crimping process, wherein the crimping tool 24 is moved in the z-direction against the anvil 23, the cable 11 must also be moved. To this end, the crimping station comprises a positioning unit 5, with which during the process of moving the press part 3 between the initial position shown in FIG. 1 the gripper 4 can be moved into an end position. The positioning unit 5 comprises a cylindrical ram 8, which can be thus lowered in the f-direction. Except for the subsequently described special positioning unit 5 and the special connection between the positioning unit and the crimping press, the present crimping station essentially corresponds to or is based on the crimping station disclosed in EP 1 351 349 A1. Therefore, reference is made to the above-mentioned document for further details regarding the construction and mode of action of the crimping press 2 and the gripper 4.

By means of a gearbox 6 designed as a lever mechanism, the positioning unit 5 is connected with the press part 3. The gearbox 6 comprises a lever 12 which supports the positioning unit 5 to which a swing arm 13 is flexibly connected. On one end the lever 12 is flexibly connected with the movable press part 3. The swing arm 13 is flexibly connected with the component 15, which is firmly fixed to the crimping press 2, and thus arranged in stationary fashion. This lever mechanism ensures that during the process of moving the press part 3 the positioning unit 5 can be moved in relation to the press part 3 at a speed that is reduced by a reduction ratio. The guides 36 for the slide 9 are arranged on the outside of the machine housing 10. A bracket 27 is screwed to the guides 36, which bracket shows a C-shaped profile when viewed from the top or in a cross-section. The extension piece 15 to which the lever mechanism of the gearbox 6 is connected is attached at a top wall of the bracket 27.

Figure 2:
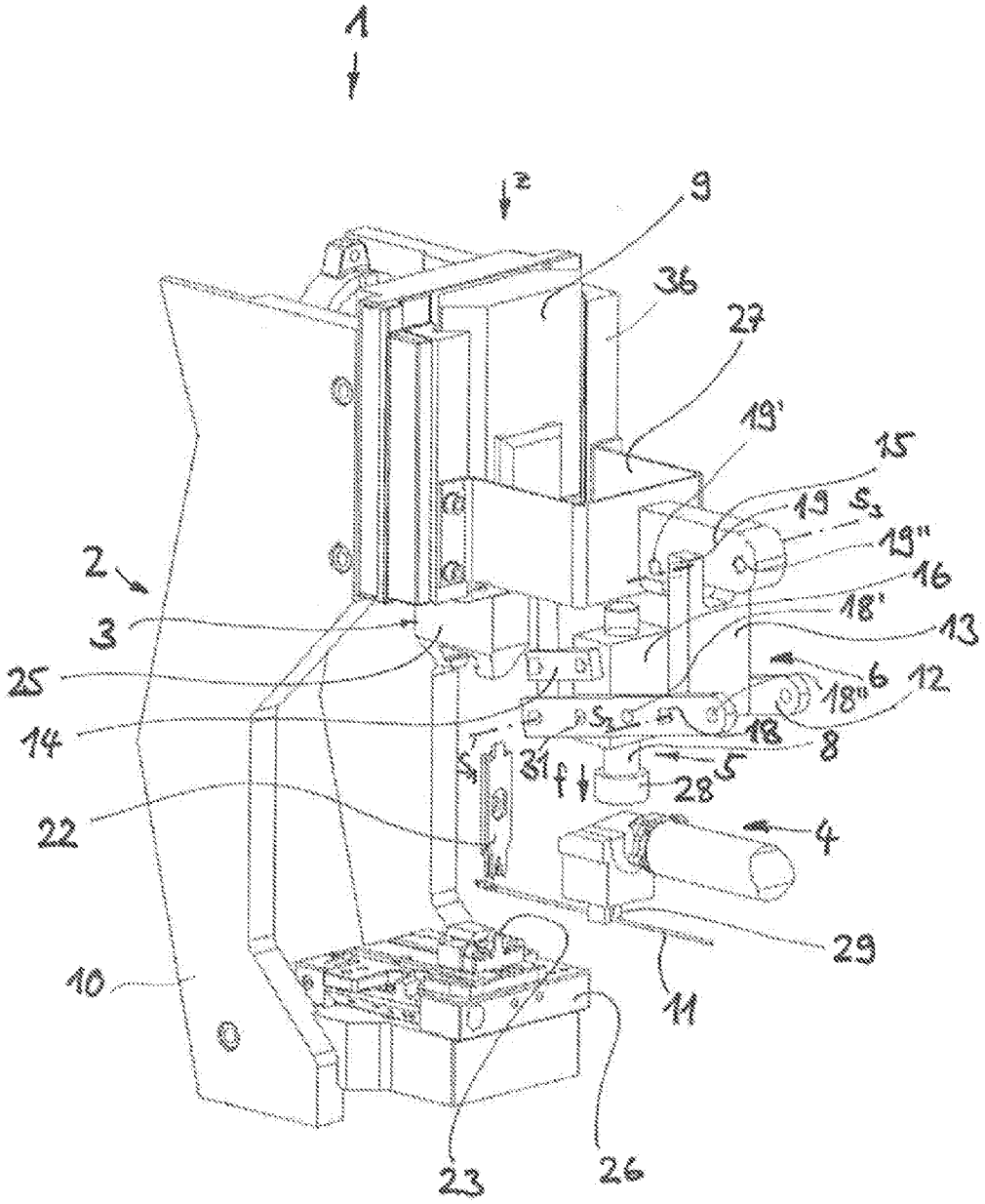
FIG. 2 shows the crimping station of FIG. 1 in a modified representation.

The representation of the crimping station according to FIG. 2 differs from the one according to FIG. 1 only in that—for a better understanding of the structure and mode of action of the invention—the crimping tool (with the exception of the crimping punch 22) and the motor are not shown. The positioning unit 5 essentially consists of a cylindrical ram 8 to which on the side of the gripper, a buffer section 28 with a slightly larger outer diameter is connected. The ram 8 is fixed, for example, in a cubical ram holder 16. The ram holder 16 is mounted to the lever 12 in such a way that it can be rotated about the bearing 31. In FIG. 2, the swivel axes of the lever mechanism are indicated and referred to as "$S_1$", "$S_2$" and "$S_3$", wherein $S_1$ concerns the swivel axis between lever 12 and press part 3; $S_2$ the swivel axis between lever 12 and swing arm 13; and $S_3$ the swivel axis between swing arm 13 and extension piece 15. A crossbeam element 14 extending parallel to the lever 12, which, on the one hand, is pivotally mounted to the press part 3 and, on the other hand, pivotally mounted to the ram holder 16, ensures that the position unit 5 can be lowered in vertical direction parallel to the press part 3. Obviously, the lever 12 and the crossbeam element 14 are arranged in pairs and in the present example, they are formed by flat bars, for example, consisting of steel.

The ram 8 is fixed in position in the ram holder 16. However, if required, the ram 8 can be moved in the ram holder 16 by means of an adjustment mechanism (e.g. at initial start-up, when changing to different cables and/or crimp connections, etc.). For example, the ram 8 is screwed via a thread into the ram holder 16, whereby the axial position of the ram 8 is changed in relation to the ram holder 16 and the newly adjusted position can be easily fixed. This adjustment possibility is particularly necessary to precisely adjust the cable position at the bottom dead center of the crimping press, and to compensate for the shift in position of the ram 8 during the adjustment process of the reduction ratio, if required.

Figure 3:
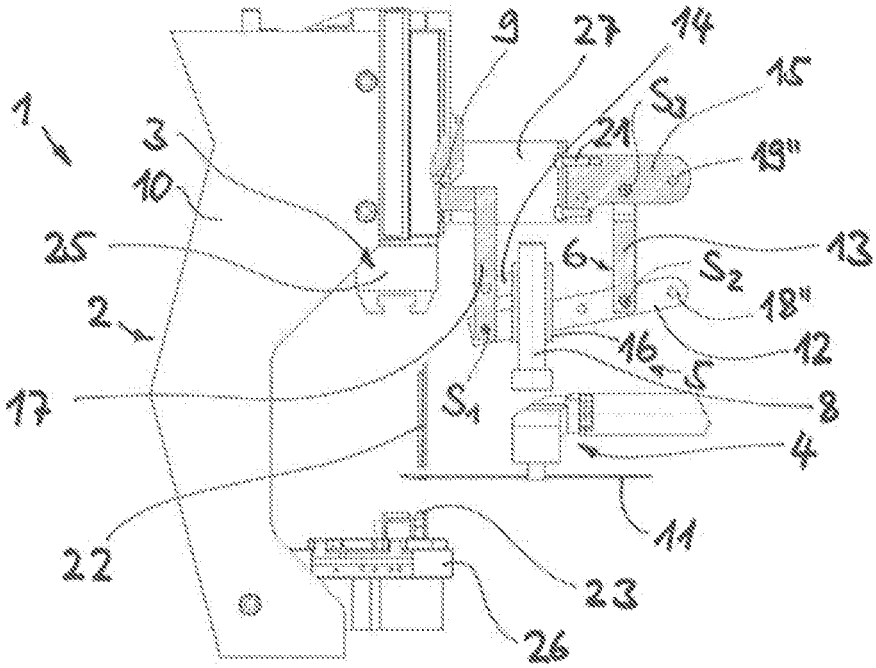
FIG. 3 is a side elevation view with a partial section of the crimping station according to FIG. 2 in a starting position.
Figure 4:
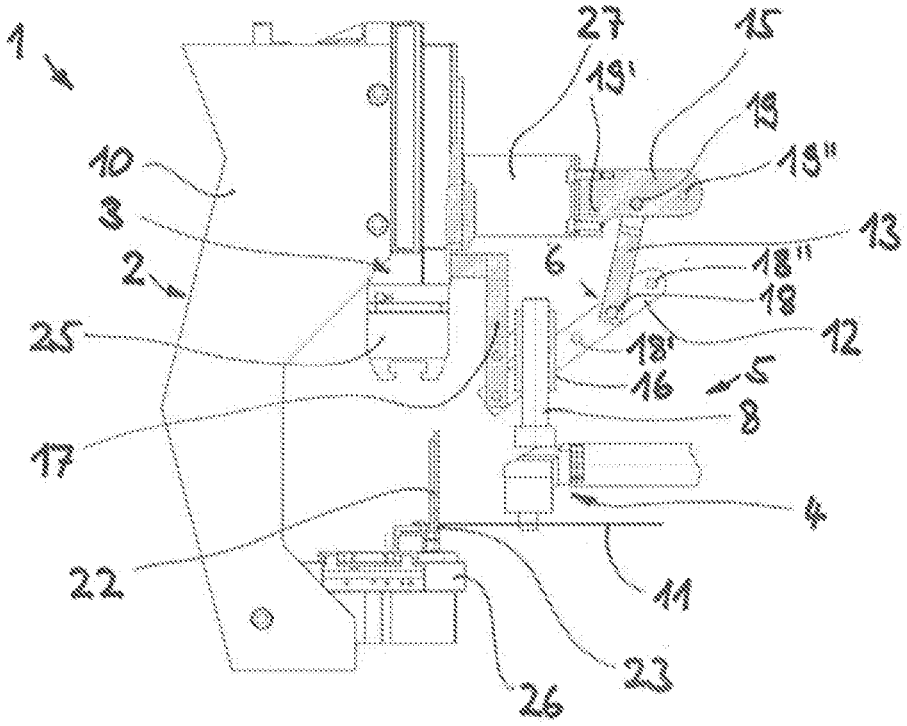
FIG. 4 is a view similar to FIG. 3 showing the crimping station in an end position.

FIGS. 3 and 4 show further details of the crimping press 1. In FIG. 3, the press part 3 with the crimping punch 22 and the positioning unit 5 are in a starting position. For example, in a crimping station with an eccentric drive according to EP 1 351 349 A1, this starting position corresponds to the upper dead center of an eccentric pin (not shown). FIG. 4 shows the crimping press 2 and the positioning unit 5 in an end position in which the crimping process has been concluded. With respect to the aforementioned example, this setting corresponds to the bottom dead center position of the eccentric pin. The lever mechanism is pivotally mounted on an angle element 17. The angle element 17 is firmly connected to the slide 9 of the press part 3. The extension piece 15 is screwed to the bracket; the corresponding mounting bolts are depicted with 21.

The swivel axis $S_2$ is fixed by means of a drill hole 18 through the respective rod of the lever 12. This drill hole 18 accepts a complementarily joint element, for example in the form of an axle stub of the swing arm 13. In addition to the drill hole 18, the lever has two more drill holes 18' and 18", which can be used as a pivot bearing for the swing arm 13. Various bearings of the swing arm 13 can also be provided in the extension piece 15. The respective bearing points designed as drill holes are depicted with 19, 19' and 19". Due to the drill holes 18, 18', 18" and 19, 19', 19" a variable transmission 6 is produced; the reduction ratio of which can be changed by selectively changing the bearing points and thus the lever geometry.

Figure 5:
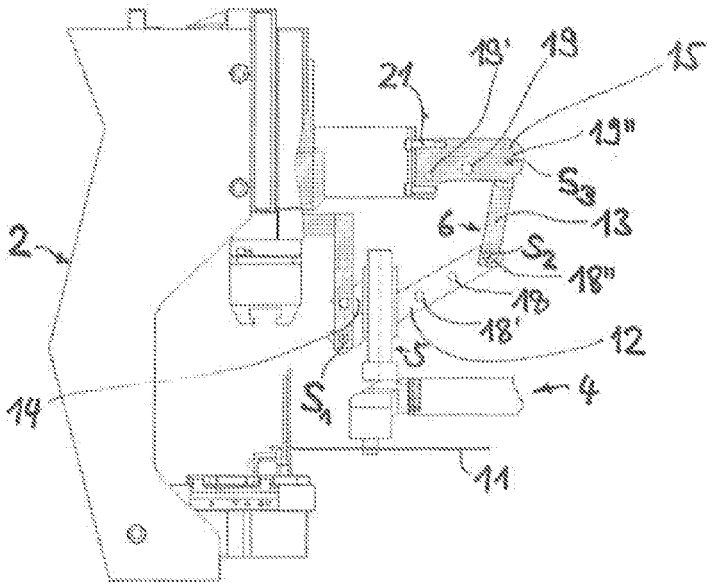
FIG. 5 shows the crimping station of FIG. 4, but with modified lever geometry.

FIG. 5 shows the crimping station 1 with the variable transmission having different lever geometry. The pivot axes $S_2$ and $S_3$ are now located in the region of the outer drill holes or bearing points 18" and 19". The drill holes and bearing points form an adjusting device or are part of an adjusting device with which the reduction ratio of the gearbox 6 can be adjusted.

The gearbox 6 shown here has only a small number of predefined positions for setting different reduction ratios. By providing more than the three drill holes or bearing points, respectively, the number of pre-defined positions, and thus the possibility of setting different reduction ratios, could be further increased. However, it is also possible to use variants (not shown) in which the reduction ratio could be adjusted continuously. A continuous variant is shown in FIG. 8. Instead of the three drill holes 19, 19' and 19" in accordance with the preceding embodiments, this particular machine element 15 comprises an oblong hole 43 with approximately the same length expansion (i.e., from 19' to 19", see, for example, FIG. 2). The oblong hole 43 forms a guide channel in which a guide member 39 has been arranged, for example in the form of a block, to be moved in linear fashion for adjusting the reduction ratio. At the guide member 39, the swing arm 13 is mounted in such a way that it can be swiveled about the pivot axis $S_3$. The guide member 39 is mounted in such a way that is can be moved via a spindle 42 in the machine element 15 and can be moved back and forth by rotating the spindle head 40 of the spindle. This movement is indicated with a double arrow. Of course, there are also different possibilities of changing the position of the pivot axis $S_3$ for the swing arm 13 (and/or the pivot axis $S_2$ for the lever 12 at the rod 41).

Figure 6:
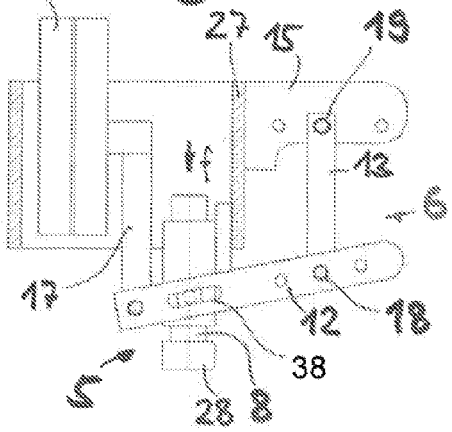
FIG. 6 shows a positioning unit of a crimping station according to a further embodiment, in a starting position.
Figure 7:
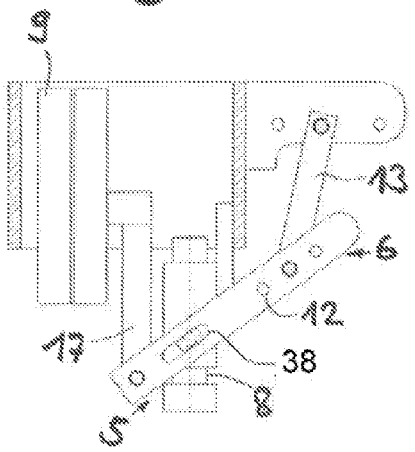
FIG. 7 shows the positioning unit of FIG. 6 in an end position.

Instead of the parallelogram guidance using the paired crossbeam element 14 shown in FIGS. 1 to 5, it is also possible to bring about the vertical lowering movement of the positioning unit in different ways. Such an alternative embodiment is shown in FIGS. 6 and 7. The positioning unit 5 is mounted is such a way that it can be moved in the f-direction in the crimping press. Instead of a fixed pivot point, the positioning unit is supported in relation to the lever 12 via a linear guide 38 designed as an oblong hole.

FIGS. 9 and 10 show that the gearbox does not necessarily have to be associated and connected with the press part. Instead, via a lever mechanism associated with the gripper head, the positioning unit 5 shown in FIGS. 8 and 9 pushes directly on the gripper head. The lever mechanism essentially consists of a lever 33, which is pivotally mounted on one end with a support element 44 that is firmly connected with the gripper arm 32. When shutting down the ram 8 during a crimping process, the lever 33 is pivoted downward in the area of the opposite end, resulting in the fact that the gripper head 34 that can be vertically moved on the guide 45 is lowered. Obviously, the connecting element 37 between gripper head 34 and lever 33 can be mounted on three different bearing points at the lever 33.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A crimping station including a crimping press for producing a crimp connection between a cable end of a cable and a crimp contact, wherein the crimping press has a drivable press part movable in a vertical direction, a gripper for supplying the cable end to the crimping press, and a positioning unit for vertically positioning the cable end at the crimping press, wherein during movement of the press part the gripper is moved by the positioning unit between a starting position and an end position, comprising:

a variable gearbox connecting the positioning unit with the press part or the gripper wherein during movement of the press part, the positioning unit is moved in relation to the press part at a speed reduced by a reduction ratio of the gearbox; and an adjusting device for adjusting the reduction ratio of the gearbox.

2. The crimping station according to claim 1 wherein the gearbox has a plurality of predetermined positions for setting different ones of the reduction ratio.

3. The crimping station according to claim 1 wherein the positioning unit is connected with the press part via a lever mechanism.

4. The crimping station according to claim 1 wherein the gearbox comprises a lever supporting the positioning unit and a swing arm flexibly connected with the lever, wherein the lever is pivotally connected with the movable press part and the swing arm is pivotally connected with a stationary component of the crimping press.

5. The crimping station according to claim 4 wherein the swing arm can be flexibly connected with the lever at a selected one of at least at two positions.

6. The crimping station according to claim 5 wherein the lever has formed therein a drill hole at each of the positions for flexibly connecting the swing arm with the lever.

7. The crimping station according to claim 4 wherein the positioning unit is connected with the press part via a cross-beam that extends parallel to the lever, or the positioning unit is mounted in the lever via a linear guide, thereby forming a parallelogram configuration.

8. The crimping station according to claim 4 wherein the stationary component is an extension piece that is releasably attached to the crimping press.

9. The crimping station according to claim 1 wherein at least two bearing points in the form of drill holes are provided at the crimping press and the swing arm can be flexibly connected at the bearing points.

10. The crimping station according to claim 9 wherein the positioning unit is connected with the press part via a cross-beam that extends parallel to the lever, or the positioning unit is mounted in the lever via a linear guide, thereby forming a parallelogram configuration.

* * * * *